US009737977B2

(12) United States Patent
Taguchi et al.

(10) Patent No.: US 9,737,977 B2
(45) Date of Patent: Aug. 22, 2017

(54) DRIVER BIT

(71) Applicant: Vessel Industrial Co., Ltd., Osaka-shi (JP)

(72) Inventors: Yasuaki Taguchi, Osaka (JP); Jiro Taguchi, Osaka (JP); Koji Chido, Osaka (JP); Koji Dohi, Osaka (JP)

(73) Assignee: Vessel Industrial Co., Ltd., Osaka-shi (JP)

( * ) Notice: Subject to any disclaimer, the term of this patent is extended or adjusted under 35 U.S.C. 154(b) by 204 days.

(21) Appl. No.: 14/563,424

(22) Filed: Dec. 8, 2014

(65) Prior Publication Data

US 2016/0158923 A1 Jun. 9, 2016

(51) Int. Cl.
*B25B 15/00* (2006.01)
*B25B 23/00* (2006.01)

(52) U.S. Cl.
CPC ..... *B25B 15/005* (2013.01); *B25B 23/0035* (2013.01)

(58) Field of Classification Search
CPC ... B25B 15/001; B25B 15/002; B25B 15/005; B25B 23/0035
See application file for complete search history.

(56) References Cited

U.S. PATENT DOCUMENTS 5,704,261 A * 1/1998 Strauch ..... B25B 15/001 81/436
5,868,047 A * 2/1999 Faust ..... B23P 15/00 81/438
6,874,791 B2 * 4/2005 Chen ..... B23B 31/1071 279/14
7,188,557 B2 * 3/2007 Yamada ..... B25B 23/0035 81/474
7,654,779 B2 * 2/2010 Sasaki ..... B23B 31/1071 279/75
7,814,815 B2 * 10/2010 Chen ..... B23B 51/00 7/165
D725,984 S * 4/2015 Moss ..... D8/86
D726,521 S * 4/2015 Moss ..... D8/86
(Continued)

FOREIGN PATENT DOCUMENTS

JP 3826549 A 5/1959
JP 451372 U 4/1992
(Continued)

*Primary Examiner* — David B Thomas
(74) *Attorney, Agent, or Firm* — The Webb Law Firm

(57) ABSTRACT

The driver bit according to the present invention includes: a tip on which a cross blade is formed; a torque transmitting part having a polygonal outer circumference; and a locking groove which extends in the circumferential direction between the tip and the torque transmitting part and into which locking balls enter, wherein the tip has four blade forming grooves forming the cross blade, the blade forming grooves are continuous with the locking groove, and the blade forming grooves are arranged so that the blade forming grooves have bottom parts, at which they are connected with the locking groove, located inwardly of the outer circumference of the torque transmitting part, and the center lines are displaced from a line connecting the shaft center with vertex positions of the polygonal outer circumference and a line connecting the shaft center with center positions of sides of the polygonal outer circumference.

4 Claims, 17 Drawing Sheets

(56) References Cited

U.S. PATENT DOCUMENTS

| | | | | |
|---|---|---|---|---|
| 9,132,534 | B2 * | 9/2015 | Lai | B25B 15/001 |
| 9,227,309 | B2 * | 1/2016 | Moss | B25B 23/0035 |
| D752,408 | S * | 3/2016 | Moss | D8/86 |
| 2005/0116429 | A1 * | 6/2005 | Chang | B25B 15/001 279/75 |
| 2011/0023666 | A1 * | 2/2011 | Hsu | B25B 23/0035 81/438 |
| 2013/0214496 | A1 * | 8/2013 | Lin | B25B 23/0035 279/46.7 |
| 2013/0340578 | A1 * | 12/2013 | Lai | B25B 15/005 81/460 |
| 2014/0097582 | A1 * | 4/2014 | Wang | B25B 23/0021 279/145 |

FOREIGN PATENT DOCUMENTS

| | | | |
|---|---|---|---|
| JP | 08300270 | A | 11/1996 |
| JP | 2001219381 | A | 8/2001 |
| JP | 2002205281 | A | 7/2002 |
| JP | 2006315166 | A | 11/2006 |
| JP | 3134009 | U | 7/2007 |
| JP | 2013049100 | A | 3/2013 |

* cited by examiner

Prior Art

Prior Art

Prior Art

DRIVER BIT

BACKGROUND OF THE INVENTION

Field of the Invention

The present invention relates to a driver bit that is detachably attached to a rotating tool such as an electric tool and an air tool and that is used for tightening or loosening a screw by transmitting the rotational torque of the rotating tool.

Background Art

A driver bit that is attached to a rotating tool such as an electric tool and an air tool and that is used for tightening or loosening a screw is known (see JP 2013-049100 A).

As shown in FIG. 15, this driver bit includes a bit body 201, tips 202, and locking grooves 203, and is used by being inserted into a socket provided in a tool coupler (such as an anvil) of the rotating tool such as an electric driver. The socket of the tool coupler is hexagonal (specifically, defined by the inner circumferential surfaces of a hexagon), and locking balls are exposed inwardly (see, for example, the reference numeral 34 in FIG. 2A and FIG. 2B). The locking balls are generally arranged at least either of the vertex positions of the hexagon and the center positions of sides forming the hexagon, and are movable in the radial direction of the socket.

The bit body 201 is a portion to which the rotational torque is transmitted from the rotating tool, and has a hexagonal outer circumference (outer circumferential surfaces) as viewed in the direction of a shaft center c1.

A tip 202 has a cross blade that is fitted to a cross recess formed on a screw head. As shown in FIG. 16, the cross blade is formed by four blade forming grooves 204 that extend outwardly from the shaft center c1 in directions orthogonal to each other, as viewed in the direction of the shaft center c1. Each of the blade forming grooves 204 is arranged so that a center line c2 of the blade forming groove 204 coincides with a line connecting the shaft center c1 and a vertex position on the outer circumference of the bit body 201 or a line connecting the shaft center c1 and a center position of a side on the outer circumference of the bit body, as viewed in the direction of the shaft center c1.

A locking groove 203 extends in the circumferential direction between the tip 202 and the bit body 201, into which the locking balls enter when the tip 202 is inserted into the socket of the tool coupler of the rotating tool. In this way, the locking balls enter into the locking groove 203, thereby allowing the tool coupler of the rotating tool to lock a driver bit 200. Specifically, when the driver bit 200 is about to fall out of the socket, the locking balls abut the sidewall of the locking groove 203 so as to suppress the movement of the driver bit 200. This prevents the driver bit 200 from falling out of the socket.

SUMMARY OF THE INVENTION

Depending on the types of rotating tools, the dimension from the bottom of the socket to the positions of the locking balls differs. Therefore, in order to enhance the versatility of the driver bit 200, it is conceivable to increase the width of the locking groove 203 (dimension in the direction of the shaft center c1).

Such an increase in the width of the locking groove 203 may possibly cause the ends of the blade forming grooves 204 on the bit body 201 side to be continuous with the locking groove 203, where the sidewall of the locking groove 203 in the portions that are continuous with the blade forming grooves 204 is lower as compared to other portions (see the shaded areas in FIG. 17). Specifically, the portions where the blade forming grooves 204 are continuous with the locking groove 203 form cutout shapes (recessed portions) 206, as viewed in the direction of the shaft center c1 (see FIG. 16).

In the tool coupler, the locking balls are generally arranged in the socket on a line connecting the center of the socket and a vertex position of the polygon, and a line connecting the center and a center position of a side constituting the polygon.

When the driver bit in which the blade forming grooves 204 are continuous with the locking groove 203 is attached to such a tool coupler, the positions in the circumferential direction of locking balls 34 (the centers of the locking balls 34) that have entered into the locking groove 203 coincide with the recessed portions 206 (the centers of the recessed portions 206) as viewed in the direction of the shaft center cl, as shown in FIG. 17. With such a state, when the driver bit is about to fall out of the socket, the locking balls 34 cannot be sufficiently caught on the sidewall of the locking groove 203. Therefore, the driver bit easily falls out of the socket.

In view of the above described problems, it is therefore an object of the present invention to provide a driver bit in which blade forming grooves are continuous with a locking groove and which is reliably locked with a tool coupler of a rotating tool by locking balls.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

A driver bit according to the present invention is attached to a tool coupler of a rotating tool including a polygonal socket and locking balls arranged at least either of vertex positions of the socket and center positions of sides constituting the polygon of the socket. The driver bit includes: a tip on which a cross blade configured to engage a cross recess formed on a screw head is formed; a torque transmitting part having a polygonal outer circumference corresponding to the socket; and a locking groove which extends in the circumferential direction of the driver bit between the tip and the torque transmitting part and into which the locking balls enter when the tip is inserted into the socket, wherein the tip has four blade forming grooves forming the cross blade, the blade forming grooves are continuous with the locking groove, and the blade forming grooves are arranged so that the blade forming grooves have bottom parts, at which they are connected with the locking groove, located inwardly of the outer circumference of the torque transmitting part, and the blade forming grooves have center lines displaced from a line connecting the shaft center with the vertex positions of the polygonal outer circumference and a line connecting the shaft center with the center positions of the sides of the polygonal outer circumference, as viewed in the direction of the shaft center.

The driver bit may have a configuration in which the outer circumference of the torque transmitting part is hexagonal, as viewed in the direction of the shaft center, and the blade forming grooves are arranged at positions such that angles of the center lines of the blade forming grooves with respect to the line connecting the shaft center with the vertex positions of the polygonal outer circumference and with respect to the line connecting the shaft center with the center positions of the sides of the polygonal outer circumference are each 15°, as viewed in the direction of the shaft center.

BRIEF DESCRIPTION OF THE DRAWINGS

The foregoing and other features of the present invention will become apparent from the following description and drawings of an illustrative embodiment of the invention in which.

DETAILED DESCRIPTION OF THE PREFERRED EMBODIMENT

Figure 1:
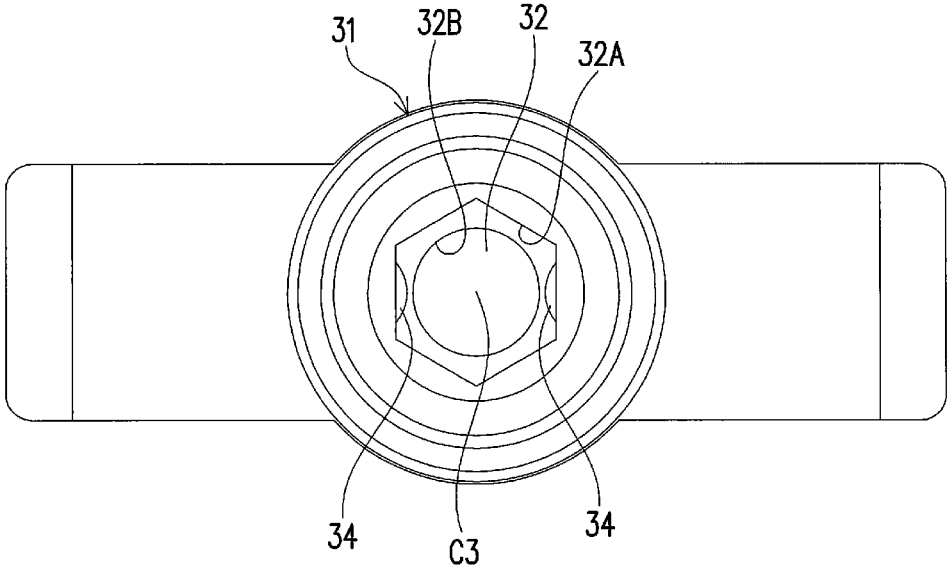
FIG. 1 is a side view of a coupler body of a tool coupler.
Figure 2A:
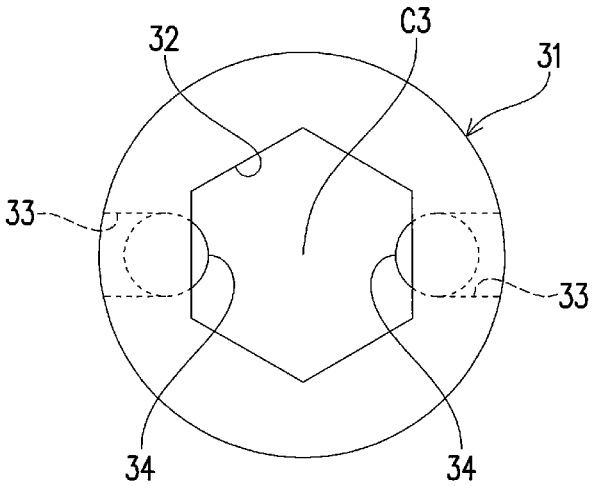
FIG. 2A is a schematic diagram showing an example of positions at which locking balls are arranged in the coupler body.
Figure 2B:
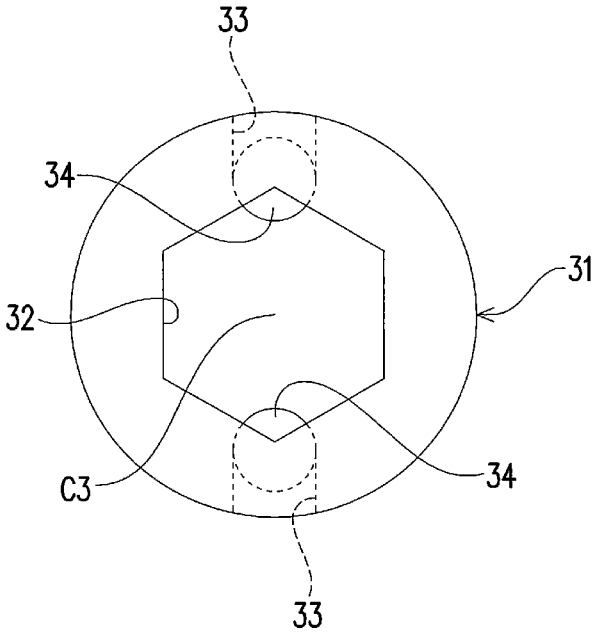
FIG. 2B is a schematic diagram showing another example of positions at which the locking balls are arranged.
Figure 3:
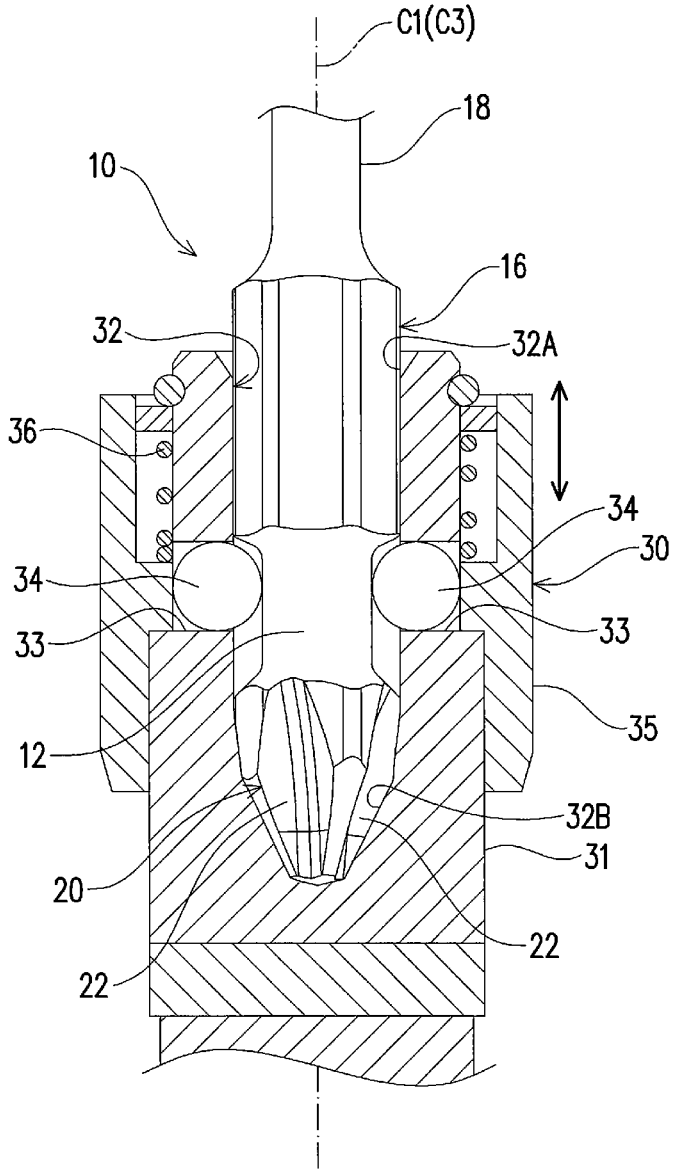
FIG. 3 is a sectional view of the tool coupler when the driver bit is inserted into a socket.

Hereinafter, an embodiment of the present invention is described with reference to the attached drawings. First, a tool coupler of a rotating tool (such as an electric driver) to which a driver bit of this embodiment is attached is described with reference to FIG. 1 to FIG. 3. FIG. 1 is a side view of a coupler body of the tool coupler. FIG. 2A is a schematic diagram showing an example of positions at which locking balls are arranged in the coupler body. FIG. 2B is a schematic diagram showing another example of positions at which the locking balls are arranged. FIG. 3 is a sectional view of the tool coupler when the driver bit is inserted into a socket.

A tool coupler 30 is a so-called anvil. As shown in FIG. 1 to FIG. 3, the tool coupler 30 includes a coupler body 31, a pair of locking balls 34, and a ball fixing part 35.

The coupler body 31 is a bottomed cylindrical member and has a bottom surface 32B and inner circumferential surfaces 32A that define a socket 32 into which a driver bit 10 is inserted. The inner circumferential surfaces 32A define the socket 32 so that the socket 32 forms a polygon (hexagon in the example of this embodiment) as viewed in an insertion direction C3 of the driver bit 10 (see FIG. 1).

The pair of locking balls 34 are arranged within through holes 33 provided through a pair of opposed surfaces on the inner circumferential surfaces 32A, as viewed in the insertion direction C3 (see FIG. 2A). The locking balls 34 are movable in the radial direction of the socket 32. The through holes 33 are provided at center positions of sides constituting the hexagon (shape of the socket 32), as viewed in the insertion direction C3.

It should be noted that the positions at which the locking balls 34 are arranged are not limited to the center positions of the sides, and they may be provided at vertex positions of the hexagon (shape of the socket 32) as viewed in the insertion direction C3, as shown in FIG. 2B. Further, the locking balls 34 may be arranged at both the center positions of the sides and the vertex positions.

The ball fixing part 35 is attached to the coupler body 31 so as to be movable in the insertion direction C3 relatively thereto. The ball fixing part 35 moves to the end position (fixing position: the position shown in FIG. 3) of the socket 32 on the bottom surface 32B side, thereby fixing the positions of the locking balls 34 with the locking balls 34 partially projecting from the inner circumferential surfaces 32A into the socket 32. That is, the ball fixing part 35 when located at the fixing position prevents the locking balls 34 projecting into the socket 32 from moving radially outwardly of the socket 32. On the other hand, the ball fixing part 35 moves to the end position (opening position) on the opening side of the socket 32, thereby allowing the locking balls 34 to move radially outwardly. The ball fixing part 35 is biased toward the fixing position by an elastic member 36.

Figure 4:
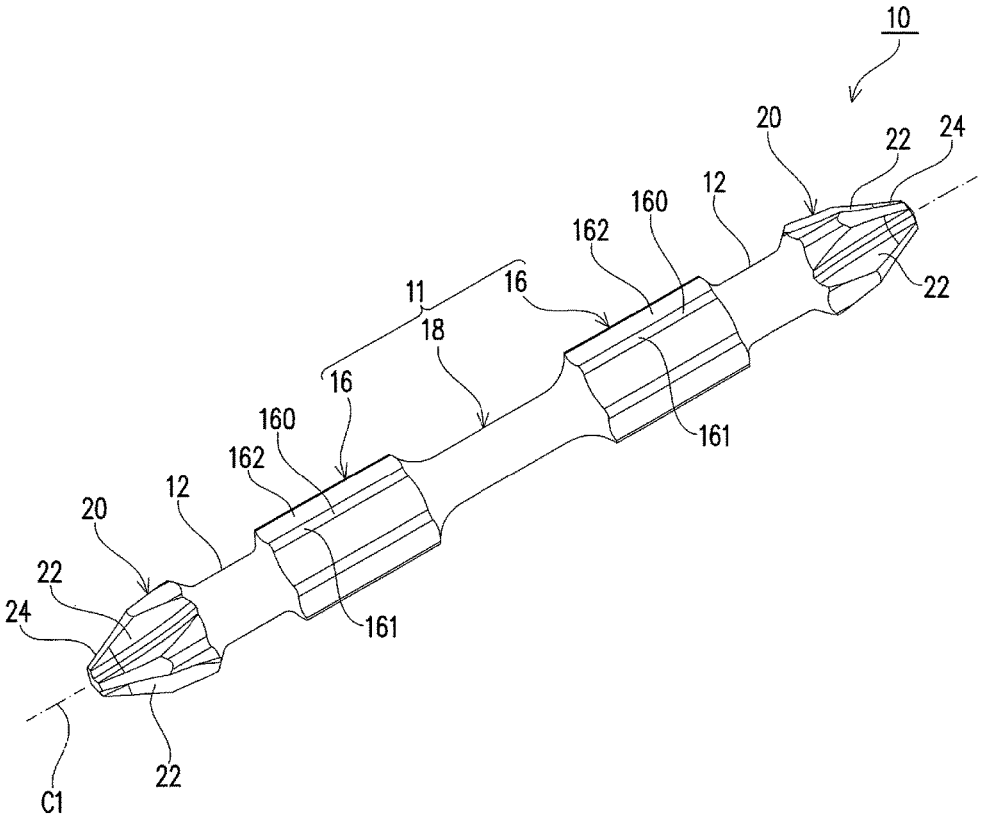
FIG. 4 is a perspective view of a driver bit according this embodiment.
Figure 5:
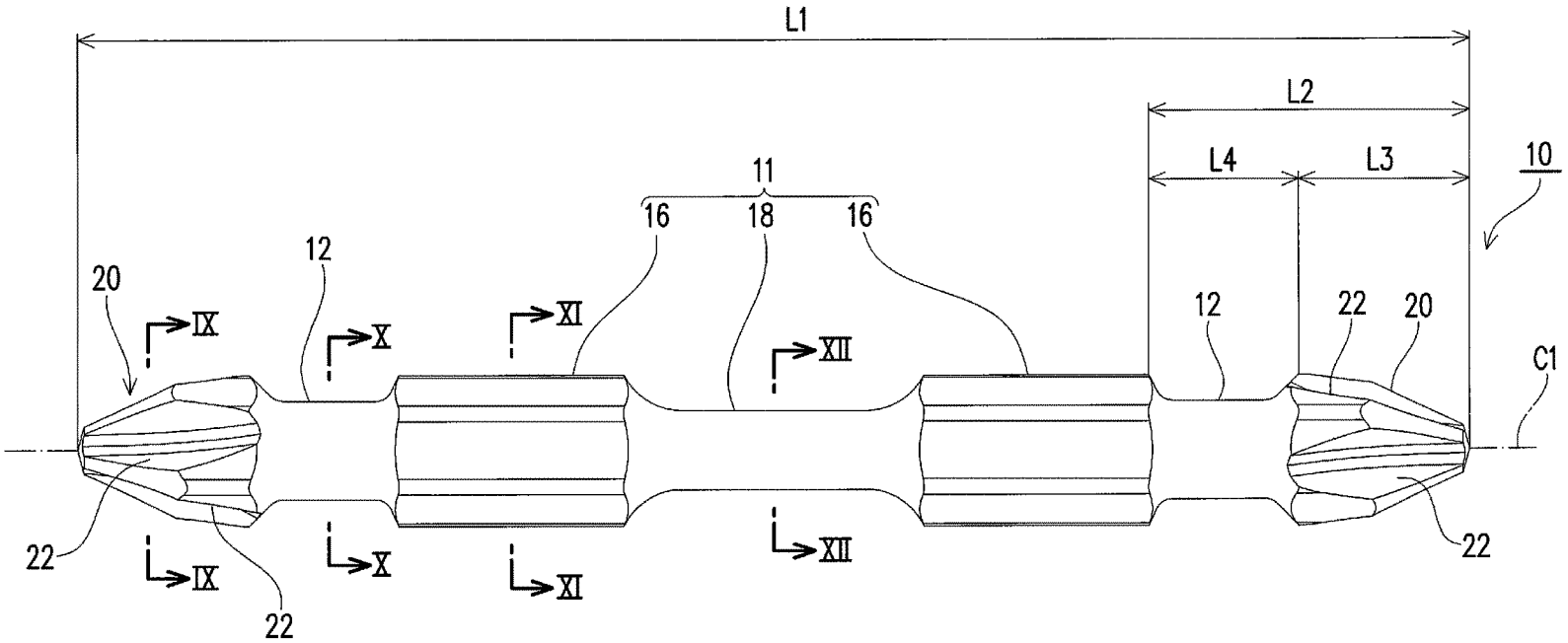
FIG. 5 is a front view of the driver bit.
Figure 6A:
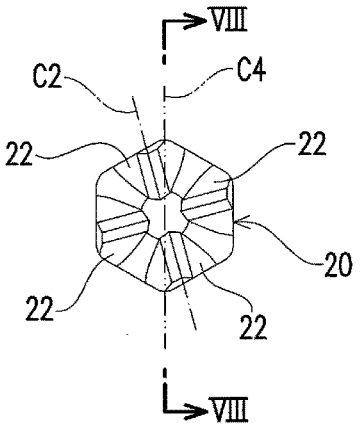
FIG. 6A is a left side view of the driver bit.
Figure 6B:
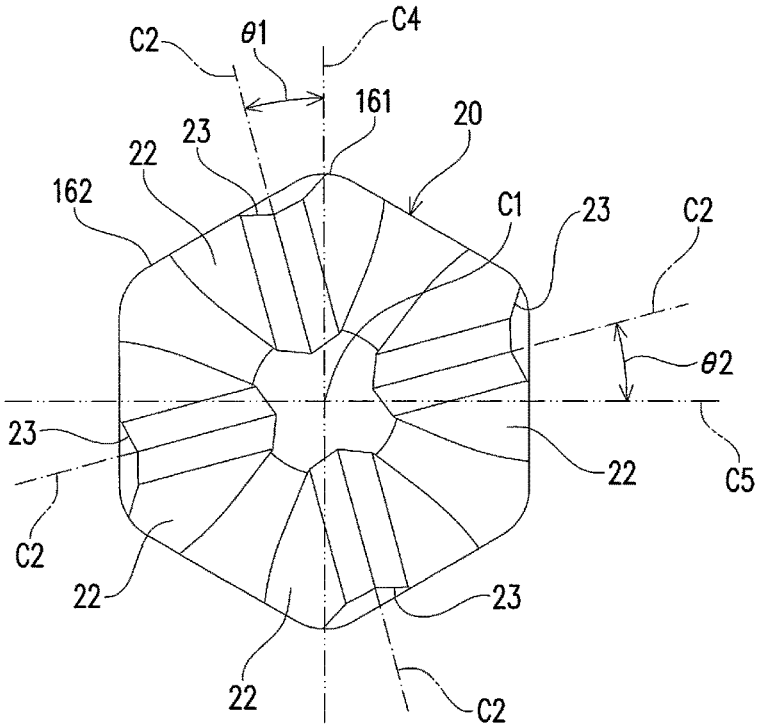
FIG. 6B is an enlarged left side view thereof.
Figure 7:
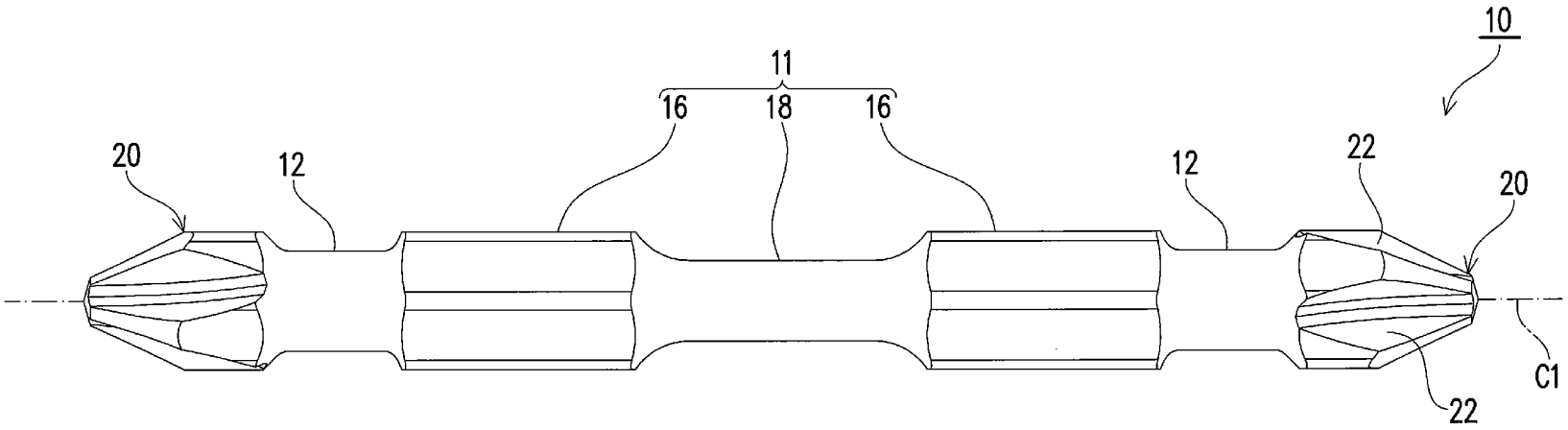
FIG. 7 is a plan view of the driver bit.
Figure 8:
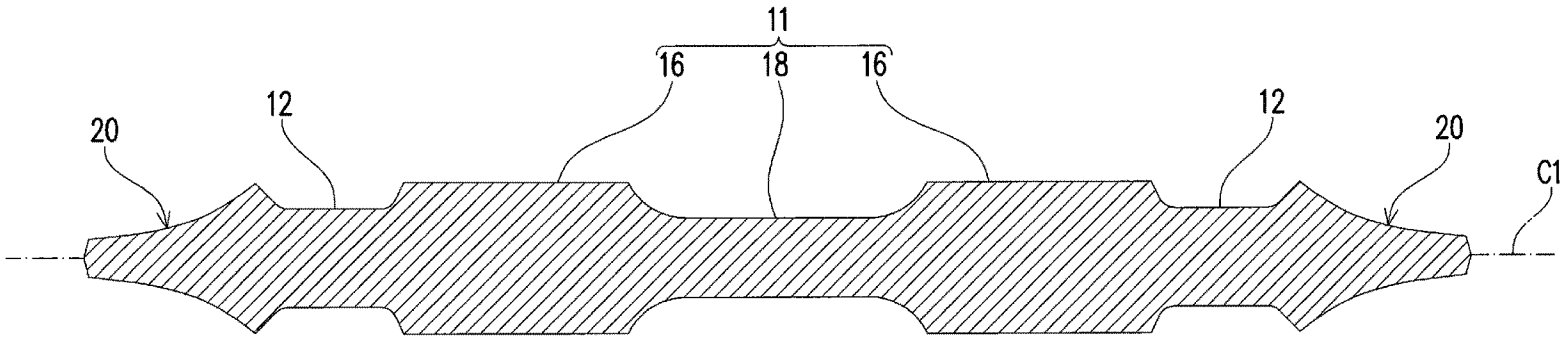
FIG. 8 is an enlarged end face view taken along the line VIII-VIII in FIG. 6A.
Figure 9:
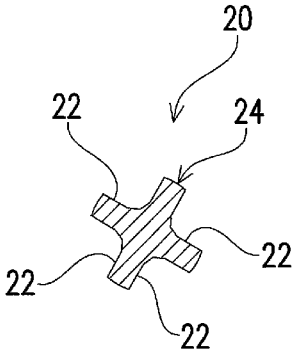
FIG. 9 is an enlarged end face view taken along the line IX-IX in FIG. 5.
Figure 10:
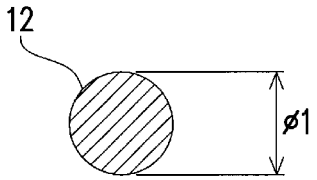
FIG. 10 is an enlarged end face view taken along the line X-X in FIG. 5.
Figure 11:
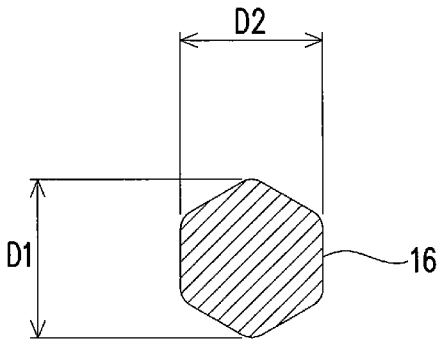
FIG. 11 is an enlarged end face view taken along the line XI-XI in FIG. 5.
Figure 12:
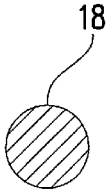
FIG. 12 is an enlarged end face view taken along the line XII-XII in FIG. 5.
Figure 13:
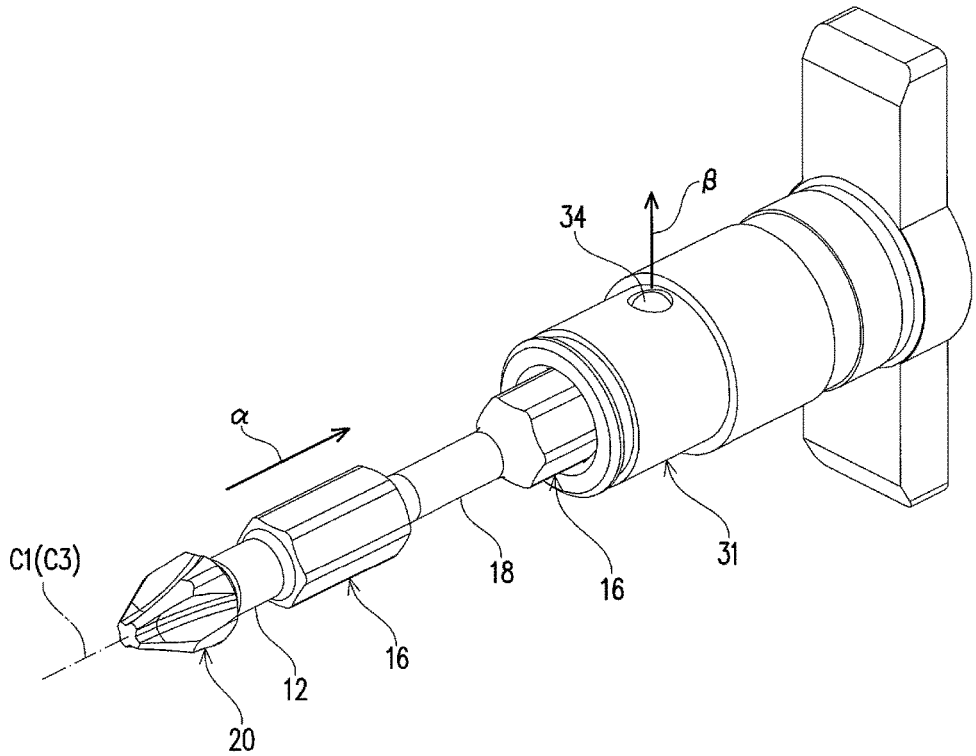
FIG. 13 is a perspective view showing the state where the driver bit is inserted into the coupler body.

Next, the driver bit 10 that is detachably attached to the tool coupler 30 is described with reference to FIG. 4 to FIG. 14. FIG. 4 is a perspective view of the driver bit according this embodiment. FIG. 5 is a front view of the driver bit. FIG. 6A is a left side view of the driver bit, and FIG. 6B is an enlarged left side view thereof. FIG. 7 is a plan view of the driver bit. FIG. 8 is an enlarged end face view taken along the line VIII-VIII in FIG. 6A. FIG. 9 is an enlarged end face view taken along the line IX-IX in FIG. 5. FIG. 10 is an enlarged end face view taken along the line X-X in FIG. 5. FIG. 11 is an enlarged end face view taken along the line XI-XI in FIG. 5. FIG. 12 is an enlarged end face view taken along the line XII-XII in FIG. 5. It should be noted that the rear view of the driver bit is the same as FIG. 5. Further, the right side view of the driver bit is the same as FIG. 6. Further, the bottom view of the driver bit is the same as FIG. 7.

The driver bit 10 of this embodiment is detachably attached to the tool coupler (such as an anvil) 30 of the rotating tool such as an electric driver, and is used for tightening or loosening a screw. As shown in FIG. 4 to FIG. 14, the driver bit 10 is a so-called double-ended bit, including a tip 20 that is fitted into a cross recess formed on a screw head at each of both ends in the direction of the shaft center C1. A specific description is given below.

The driver bit 10 includes a bit body 11, a pair of tips 20, a pair of locking grooves 12. Further, the bit body 11 includes a pair of torque transmitting parts 16 and a small diameter part 18.

A torque transmitting part 16 is a portion which has a polygonal outer circumference corresponding to the socket 32 of the tool coupler 30 and to which a rotational torque is transmitted from the rotating tool. The torque transmitting part 16 of this embodiment has outer circumferential surfaces (outer circumference) 160 forming a hexagonal contour, as viewed in the direction of the shaft center C1. It should be noted that a portion corresponding to each vertex of the hexagon of the outer circumference 160 is composed of a curved surface (see FIG. 11).

The small diameter part 18 is a portion which has a smaller diameter than the torque transmitting parts 16 and partially absorbs the internal stress that occurs when a screw is tightened or loosened by twisting about the shaft center C1.

The tip 20 has a cross blade 24 formed by four blade forming grooves 22. That is, the tip 20 is a head of the so-called Phillips type. The cross blade 24 is fitted to a cross recess formed on a head of a screw when the screw is tightened or loosened.

Specifically, the four blade forming grooves 22 extend outwardly from the shaft center C1 in directions orthogonal to each other as viewed in the direction of the shaft center C1, as shown in FIG. 6B. The blade forming grooves 22 are arranged so that center lines C2 of the blade forming grooves 22 are displaced from a line C4 connecting the shaft center C1 with vertex positions 161 of the hexagonal outer circumference 160 and a line C5 connecting the shaft center C1 with center positions of sides 162 of the hexagonal outer circumference 160.

The four blade forming grooves 22 of this embodiment are arranged at positions such that angles θ1 of the center lines C2 of the blade forming grooves 22 with respect to the line C4 connecting the shaft center C1 with the vertex positions 161 of the hexagonal outer circumference 160, and angles θ2 of the center lines C2 with respect to the line C5 connecting the shaft center C1 with the center positions of the sides 162 of the hexagonal outer circumference 160 are each 15°, as viewed in the direction of the shaft center C1.

It should be noted that the angles θ1 formed by the line C4 and the center lines C2 of the blade forming grooves 22 are not limited to 15°. The blade forming grooves 22 need only to be arranged so that the center lines C2 of the blade forming grooves 22 are displaced from the line C4 and the line C5, as viewed in the direction of the shaft center C1. For example, the angles θ1 may be in the range of preferably $7.5° < \theta 1 < 22.5°$, more preferably $10° < \theta 1 < 20°$.

The blade forming grooves 22 as described above are formed, for example, by cutting the tip 20 having a substantially conical shape.

A locking groove 12 extends in the circumferential direction between the tip 20 and the bit body 11 (specifically, a torque transmitting part 16), into which the locking balls 34 projecting into the socket 32 enter when the tip 20 is inserted into the socket 32 of the tool coupler 30 (see FIG. 3). The locking groove 12 is continuous with the ends of the blade forming grooves 22 on the torque transmitting part 16 side. Thus, the sidewall (sidewall on the tip side) of the locking groove 12 in the portions that are continuous with the blade forming grooves 22 is lower as compared to other portions (see FIG. 6B and FIG. 7). Portions 23 where the sidewall is lower are portions where the shape of the blade forming grooves 22 partially appears on the sidewall of the locking groove 12 at the position where the blade forming grooves 22 are connected with the locking groove 12. In other words, the blade forming grooves 22 have bottom parts, at which the blade forming grooves 22 are connected with the locking groove 12, located inwardly (on the center shaft C1 side) of the outer circumference of the torque transmitting part 16, as viewed in the shaft center C1 direction.

The driver bit 10 configured as above, for example, has specific dimensions as follows.

The driver bit 10 shown FIG. 5 has a total length L1 of 90 to 150 mm, a dimension L2 from the tip to the torque transmitting part 16 of 12.8 to 15 mm, a length L3 of the tip 20 of 8 mm, and a width L4 of the locking groove 12 of 4.8 to 7 mm. Further, the driver bit 10 has a diameter ϕ1 of 4.6 mm at the position where the locking groove 12 shown in FIG. 10 is provided. Further, a diameter D1 in the diagonal direction of the torque transmitting part 16 shown in FIG. 11 is 7.18 mm, and a diameter D2 in the opposite side direction thereof is 6.35 mm.

The driver bit 10 configured as above is attached to or detached from the tool coupler 30 as follows.

The ball fixing part 35 is moved to the opening position against the biasing force of the elastic member 36. This enables the locking balls 34 to move radially outwardly of the socket 32. When the driver bit 10 is inserted into the socket 32 with such a state (see the arrow a in FIG. 13), the locking balls 34 projecting from the inner circumferential surfaces 32A into the socket 32 are moved radially outwardly by being pushed by the tip 20 (see the arrow B in FIG. 13), and the tip 20 is inserted further over the position where the locking balls 34 of the socket 32 are arranged.

Figure 14:
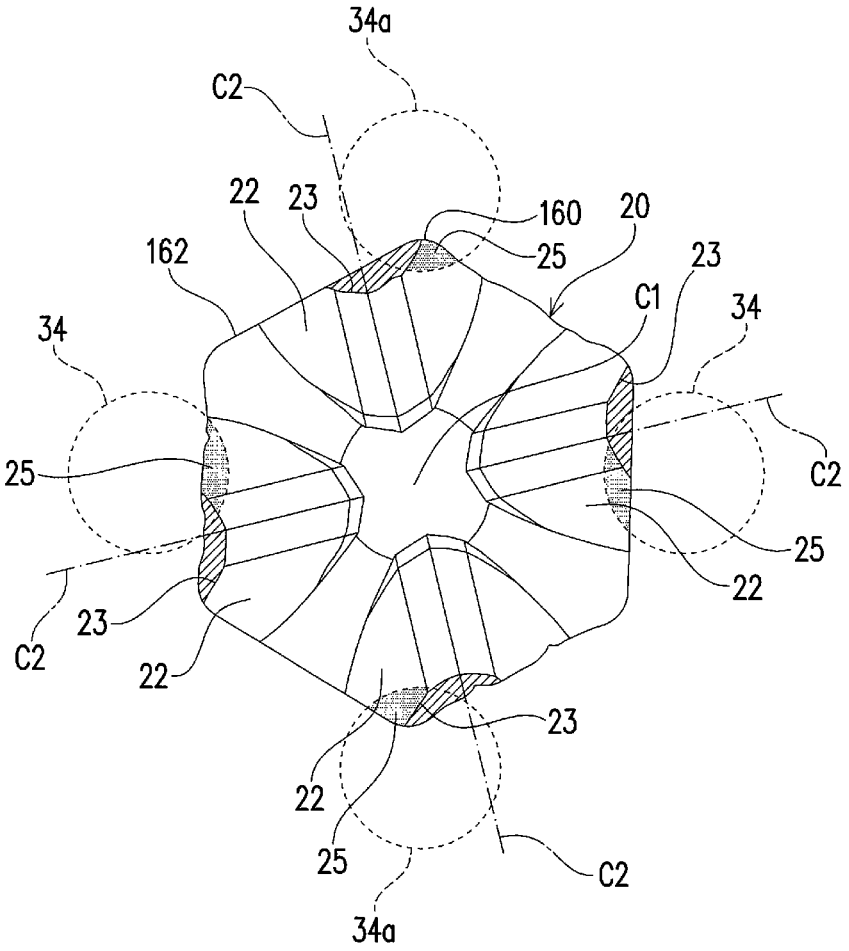
FIG. 14 is a view for explaining the portions where locking balls are caught on a sidewall of a locking groove of the driver bit.
Figure 15:
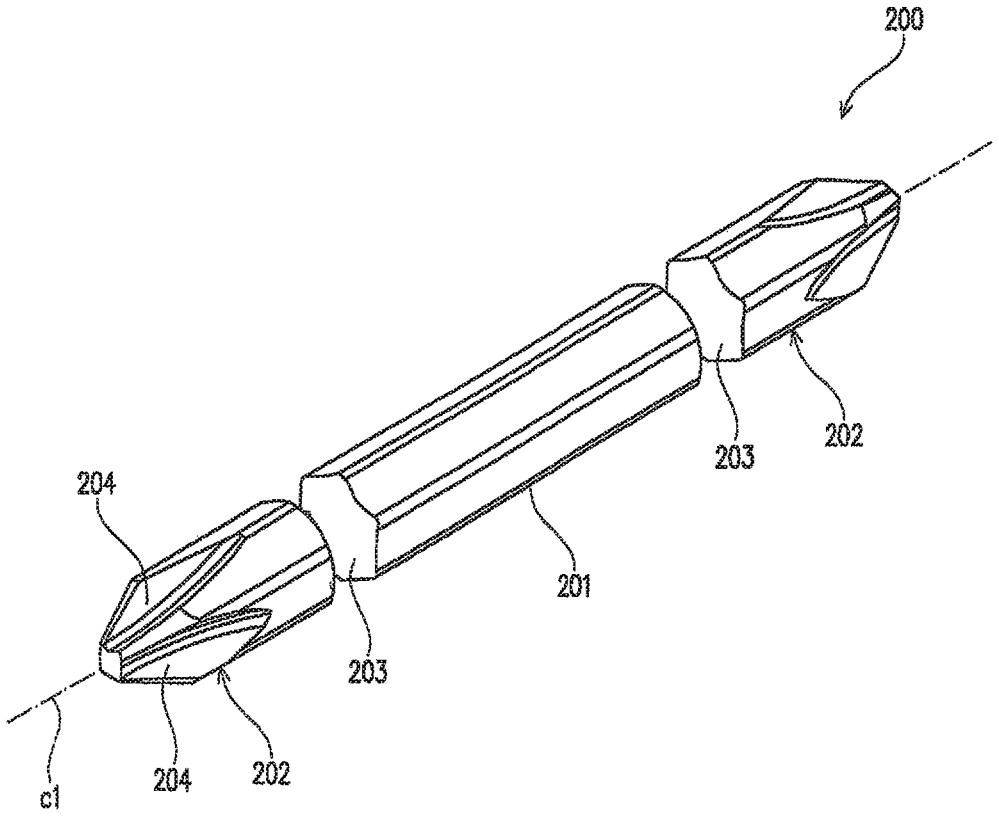
FIG. 15 is a conventional perspective view of a driver bit.
Figure 16:
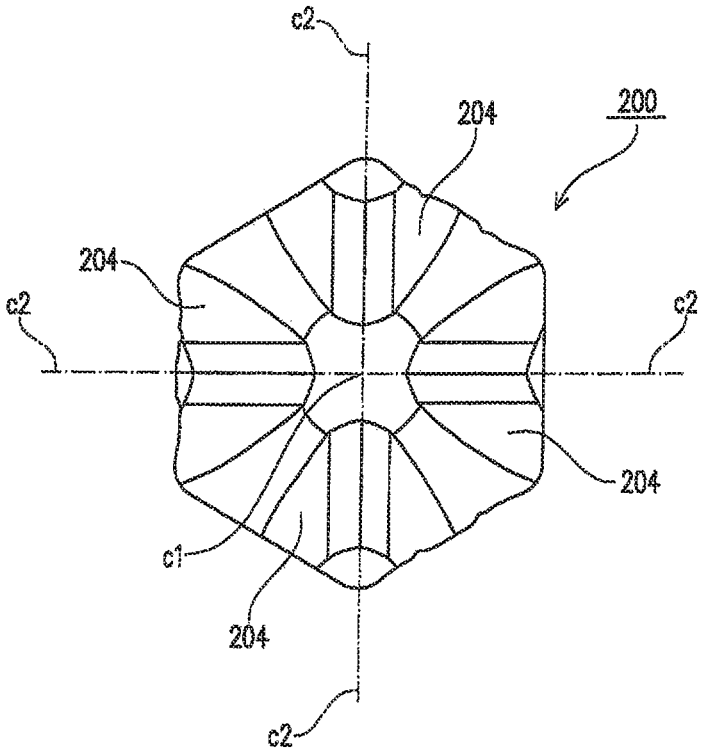
FIG. 16 is an enlarged left side view of the driver bit.
Figure 17:
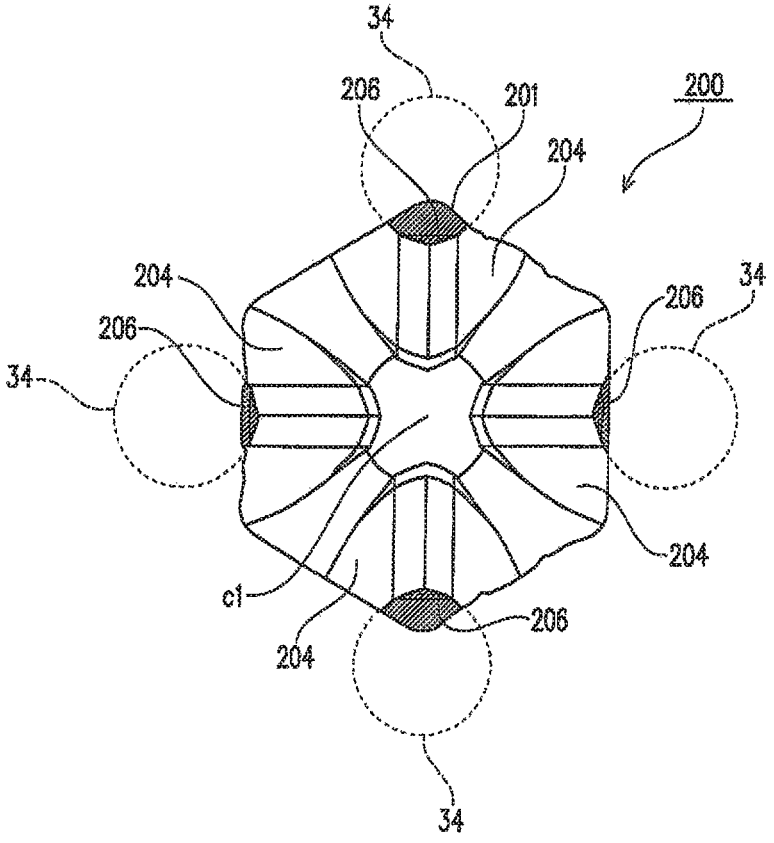
FIG. 17 is a view for explaining the portions where locking balls are caught by a locking groove of the driver bit.

Subsequently, the ball fixing part 35 is returned to the fixing position (position shown in FIG. 3). Thus, the locking balls 34 partially project from the inner circumferential surfaces 32A into the socket 32 and enter into the locking groove 12, and the locking balls 34 are fixed at such positions where they enter into the locking groove 12. At this time, the center lines C2 of the blade forming grooves 22 are displaced in the circumferential direction of the driver bit 10 to positions different from the centers of the locking balls 34 arranged within the socket 32, that is, the center lines C2 of the blade forming grooves 22 are displaced from the centers of the locking balls 34 in the circumferential direction. Therefore, regions 25 on the sidewall of the locking groove 12 catching the locking balls 34 are increased, as compared to the case where the center lines C2 of the blade forming grooves 22 coincide with the centers of the locking balls 34 (see FIG. 17), as shown in FIG. 14. Accordingly, the driver bit 10 is reliably locked with the tool coupler 30 even if the blade forming grooves 22 are continuous with the locking groove 12. It should be noted that members denoted by the reference numeral 34*a* in FIG. 14 indicate the positions of the locking balls when they are arranged at the vertex positions of the hexagon formed by the inner circumferential surfaces 32A of the tool coupler 30.

Further, in the driver bit 10, the four blade forming grooves 22 are arranged at positions such that the angles θ1 of the center line C2 of the blade forming groove 22 with respect to the line C4 connecting the shaft center C1 with the vertex positions 161 of the hexagonal outer circumference 160, and the angles θ2 of the center line C2 of the blade forming groove 22 with respect to the line C5 connecting the shaft center C1 with the center positions of the sides 162 of the hexagonal outer circumference 160 are each 15°, as viewed in the direction of the shaft center C1. Therefore, the regions 25 on the sidewall of the locking groove 12 catching the locking balls 34 are most increased, so that the driver bit 10 is reliably locked with the tool coupler 30.

On the other hand, when the driver bit 10 is detached from the tool coupler 30, a reverse operation of the attachment is performed. Specifically, the ball fixing part 35 is first moved to the opening position. This enables the locking balls 34 that have been fixed at positions entering into the locking groove 12 to move radially outwardly of the socket 32. With such a state, the driver bit 10 is moved to the opening direction of the socket 32, thereby allowing the driver bit 10 to be detached from the tool coupler 30.

As described above, the driver bit 10 according to this embodiment is configured to be attached to the tool coupler 30 of a rotating tool including the polygonal socket 32 and the locking balls 34 arranged at least either of the vertex positions of the socket 32 and the center positions of the sides constituting the polygon of the socket 32. This driver bit includes the tip 20 having the cross blade 24 fitted to a cross recess formed on a screw head, the torque transmitting part 16 which has a polygonal outer circumference corresponding to the socket 32 and is configured to transmit a rotational torque from the rotating tool, and the locking groove 12 which extends in the circumferential direction of the driver bit 10 between the tip 20 and the torque transmitting part 16 and into which the locking balls 34 enter when the tip 20 is inserted into the socket 32. The tip 20 has the four blade forming grooves 22 forming the cross blade 24 by extending from the shaft center C1 outwardly in directions orthogonal to each other, as viewed in the direction of the shaft center C1 of the driver bit 10. Further, the locking groove 12 is continuous with the ends of the blade forming grooves 22 on the torque transmitting part 16 side, and the blade forming grooves 22 are arranged so that the center lines C2 of the blade forming grooves 22 are displaced from the line C4 connecting the shaft center C1 with the vertex positions 161 of the polygonal outer circumference and the line C5 connecting the shaft center C1 with the center positions of the sides 162 of the polygonal outer circumference, as viewed in the direction of the shaft center C1.

According to such a configuration, when the driver bit 10 is attached to the tool coupler 30, the center lines C2 of the blade forming grooves 22 are displaced from the centers of the locking balls 34 in the circumferential direction. Therefore, regions on the sidewall of the locking groove 12 catching the locking balls 34 (for example, smoked portions in FIG. 14) are increased, as compared to the case where the center lines C2 of the blade forming grooves 22 coincide with the centers of the locking balls 34 in the circumferential direction (for example, see FIG. 17). Therefore, the driver bit 10 configured as above is reliably locked with the tool coupler 30 even if the blade forming grooves 22 are continuous with the locking groove 12.

Further, in the driver bit 10 according to this embodiment, the outer circumference of the torque transmitting part 16 is hexagonal as viewed in the direction of the shaft center C1, and the blade forming grooves 22 are arranged at positions such that angles of the center lines C2 of the blade forming grooves 22 with respect to a line connecting the shaft center C1 with the vertex positions 161 of the polygonal outer circumference and with respect to the line C5 connecting the shaft center C1 with the center positions of the sides 162 of the polygonal outer circumference are each 15°, as viewed in the direction of the shaft center C1.

According to such a configuration, the portions on the sidewall of the locking groove 12 catching the locking balls 34 are most increased. Therefore, the driver bit 10 is reliably locked with the tool coupler 30.

It should be noted that the driver bit of the present invention is not limited to the above described embodiment, and it is a matter of course that various modifications can be made without departing from the gist of the present invention.

The driver bit 10 according to the above described embodiment is a double-ended bit having the tips 20 of the same shape on both ends. However, there is no limitation to this configuration. For example, the driver bit may have the tip 20 which has the cross blade 24 and in which the ends of the blade forming grooves 22 are continuous with the locking groove 12 at one end, and a tip having a different shape at the other end.

Further, the driver bit 10 according to the above described embodiment is used for a rotating tool using air pressure or electricity such as an electric driver. However, it may be used for a manually operated tool.

The driver bit of the present embodiment is as described above. However, the present invention is not limited to the above described embodiment, and the design can be appropriately modified within the scope intended by the present invention. The operational advantage of the present invention is also not limited to the foregoing embodiment.

The embodiment disclosed herein should be construed in all respects as illustrative but not limiting. The scope of the present invention is not indicated by the foregoing description but by the scope of the claims. Further, the scope of the present invention is intended to include all the modifications equivalent in the sense and the scope to the scope of the claims.

What is claimed is:

1. A driver bit configured to be attached to a tool coupler of a rotating tool including a polygonal socket and locking balls arranged at least either of vertex positions of the socket and center positions of sides constituting the polygon of the socket, comprising:

a tip on which a cross blade configured to engage a cross recess formed on a screw head is formed;

a torque transmitting part having a polygonal outer circumference corresponding to the socket and being configured to receive the rotational torque from the rotating tool; and a locking groove which extends in the circumferential direction of the driver bit between the tip and the torque transmitting part and into which the locking balls enter when the tip is inserted into the socket, wherein the tip has four blade forming grooves that extend outwardly from a shaft center of the driver bit in directions orthogonal to each other as viewed in the direction of the shaft center, thereby forming the cross blade, the locking groove is continuous with ends of the blade forming grooves on the torque transmitting part side; and the blade forming grooves have center lines respectively passing centers of the blade forming grooves, and are arranged so that the blade forming grooves have bottom parts, at which they are connected with the locking groove, located inwardly of the outer circumference of the torque transmitting part, wherein the center line of each of the blade forming grooves is displaced from a line connecting the shaft center with each corresponding one of the vertex positions of the polygonal outer circumference and a line connecting the shaft center with the center position of each corresponding one of the sides of the polygonal outer circumference, as viewed in the direction of the shaft center.

2. The driver bit according to claim 1, wherein the outer circumference of the torque transmitting part is hexagonal, as viewed in the direction of the shaft center, and the blade forming grooves are arranged at positions such that an angle of the center line of each of the blade forming grooves with respect to the line connecting the shaft center with each corresponding one of the vertex positions of the polygonal outer circumference and with respect to the line connecting the shaft center with the center position of each corresponding one of the sides of the polygonal outer circumference is 15°, as viewed in the direction of the shaft center.

3. A driver bit configured to be attached to a tool coupler of a rotating tool including a polygonal socket and locking balls arranged at least either of vertex positions of the socket and center positions of sides constituting the polygon of the socket, comprising:

a tip on which a cross blade configured to engage a cross recess formed on a screw head is formed;

a torque transmitting part having a polygonal outer circumference corresponding to the socket and being configured to receive the rotational torque from the rotating tool; and a locking groove which extends in the circumferential direction of the driver bit between the tip and the torque transmitting part and into which the locking balls enter when the tip is inserted into the socket, wherein the tip has four blade forming grooves that extend outwardly from a shaft center of the driver bit in directions orthogonal to each other as viewed in the direction of the shaft center, thereby forming the cross blade, the tip has an inward end portion through which the tip is continuous with the locking groove, and the inward end portion of the tip has a polygonal outer circumference with vertices respectively corresponding to the vertex positions of the polygonal outer circumference of the torque transmitting part and sides corresponding to the sides of the polygonal outer circumference of the torque transmitting part, the locking groove is continuous with the ends of the blade forming grooves on the torque transmitting part side, the blade forming grooves have center lines respectively passing centers of the blade forming grooves, and are arranged so that the blade forming grooves have bottom parts, at which they are connected with the locking groove, located inwardly of the outer circumference of the torque transmitting part, wherein the center line of each of the blade forming grooves is displaced from a first line connecting the shaft center with each corresponding one of the vertex positions of the polygonal outer circumference and a second line connecting the shaft center with the center position of each corresponding one of the sides of the polygonal outer circumference, as viewed in the direction of the shaft center, and the blade forming grooves are arranged respectively to overlap with the first line and the second line as viewed in the direction of the shaft center, and the inward end portion of the tip has at least one of a first region and a second region, wherein the first region lies on the first line passing the corresponding blade forming groove and includes the corresponding vertex, and is configured to come into locking engagement with the locking ball, and the second region lies on the second line passing the corresponding blade forming groove and includes the corresponding side, and is configured to come into locking engagement with the locking ball.

4. The driver bit according to claim 3, wherein the outer circumference of the torque transmitting part is hexagonal, as viewed in the direction of the shaft center, and the blade forming grooves are arranged at positions such that an angle of the center line of each of the blade forming grooves with respect to the first line connecting the shaft center with each corresponding one of the vertex positions of the polygonal outer circumference and with respect to the second line connecting the shaft center with the center position of each corresponding one of the sides of the polygonal outer circumference is 15°, as viewed in the direction of the shaft center.

* * * * *